United States Patent [19]

Stakenborg et al.

[11] Patent Number: 4,674,864

[45] Date of Patent: Jun. 23, 1987

[54] CONTROL MEANS FOR VARYING THE IMAGE-FREE EDGE ZONES OF A COPY IN A REPRODUCTION DEVICE

[75] Inventors: Addy G. F. Stakenborg, Venlo; Andreas T. Heynen, Tegelen; Gerardus J. M. Hendericks, Venlo, all of Netherlands

[73] Assignee: Oce-Nederland B.V., Venlo, Netherlands

[21] Appl. No.: 821,757

[22] Filed: Jan. 23, 1986

[30] Foreign Application Priority Data

Jan. 25, 1985 [NL] Netherlands ..... 8500197

[51] Int. Cl.[4] ..... G03G 15/00

[52] U.S. Cl. ..... 355/14 R; 355/55

[58] Field of Search ..... 355/14 R, 14 C, 14 SH, 355/7, 3 R, 55–57, 60

[56] References Cited

U.S. PATENT DOCUMENTS

| | | | |
|---|---|---|---|
| 4,568,181 | 2/1986 | Nishiyama | 355/14 SH |
| 4,575,227 | 3/1986 | Ito et al. | 355/14 R |
| 4,585,332 | 4/1986 | Shenoy | 355/14 R |

*Primary Examiner*—R. L. Moses

*Attorney, Agent, or Firm*—Reed Smith Shaw & McClay

[57] ABSTRACT

In a reproduction device for making simplex or duplex copies having image-free side margins of the desired width, means are provided for supplying to the process control unit of the device data concerning the width of each of two oppositely situated image-free side margins of the original to be reproduced and the required minimum width of the corresponding side margins on the copies to be produced and calculating in the process control unit the imaging ratio and an adjustment or activation time of at least one of the copy forming process functions and then they control the copying process in accordance with these calculated values.

4 Claims, 6 Drawing Figures

CONTROL MEANS FOR VARYING THE IMAGE-FREE EDGE ZONES OF A COPY IN A REPRODUCTION DEVICE

FIELD OF THE INVENTION

This invention relates to a means for varying the free edges of a copy in a reproduction device in which an image is transferred from a temporary image support to a sheet of receiving material, and in particular, to a device which includes imaging means with which the imaging ratio can be varied.

BACKGROUND OF THE INVENTION

In image reproduction devices having the capability of varying the image ratio of the image produced, it is desirable to be able to control the size of the image-free zones, such as the margins. For example, copying apparatus have been developed in which the width of a binding margin can be controlled, U.S. Pat. Nos. 4,501,490 and 3,967,896 or where the size of the original is smaller than the transfer means, charge quenching has been used to maintain a clean margin. U.S. Pat. No. 4,384,785. Additionally, various charge quenching devices are used to eliminate unnecessary charges on the non-imaged area of a photoconductor, e.g., British application G.B. No. 2012073A.

In U.S. Pat. No. 3,967,896, which describes a copying device in which it is possible to make copies whose image-free edge zones on the left and right of the copy (side margins) are sufficiently wide for fastening or binding edge at the left-hand side by charging these image-free zones. However, in so doing there is a loss of information-which results from changing the width of image-free edge zones. This loss can be obviated by reproducing the image of the original in a somewhat reduced scale on the copy. The correct adjustments of the copying device must be manually determined by the operator by making one or more sample copies.

U.S. Pat. Nos. 4,162,844 and 4,187,024 describe similar copying devices suitable for making double-sided copies (duplex copies) and having adjustment facilities to make the image-free edge zones on the front and the reverse sides of the copy to coincide. As with the device described above these require the operator to determine the correct adjustments by making sample copies.

The need to make sample copies is a distinct disadvantage of the prior art devices. This is particularly the case when a reduction in the size of the image appears to be necessary to avoid loss of information on the copies. In such a case determination of the correct machine adjustments can be very time-consuming. Accordingly, it is an object of the present invention to provide a reproduction device in which it is possible to supply to the control means data concerning the width of each of two oppositely situated image-free edge zones of an original to be reproduced together with the required minimum width of the corresponding edge zones on the sheet of receiving material to calculate the image ratio and activation time of the process controls. It is a further object of the invention to provide control means which utilize the data supplied for calculating the imaging ratio and an adjustment or an activation time of at least one of the process functions in order to obtain the required minimum width of the edge zones and also generating control signals to control the relevant process functions in accordance with the calculated values; thus overcoming the limitations inherent in prior art devices.

SUMMARY OF INVENTION

The present invention provides control means which are used to supply data to the process control means of the reproduction device concerning the width of each of two oppositely located image-free edge zones.

Since the control means themselves determine the imaging ratio and the final width of the image-free edge zones on the receiving material only the minimum requirements need to be set by the operator. The invention eliminates the need to make sample copies to determine the correct machine adjustments. Accordingly, a copying job can thus be carried out more quickly.

In a preferred embodiment of the invention, the control means comprise a memory in which the data concerning the minimum width of the image-free edge zones can be permanently programmed. Consequently, in the preferred embodiment the operator does not need to reinput these data for each copying job. The memory is preferably a read/write memory (RAM), so that the operator can change the programmed data or have them changed by a service engineer.

According to another embodiment of the invention, the reproduction device is also provided with means with which details concerning the dimensions of the original and the sheet of receiving material can be fed to the control means. In this way the width of the imagage-free edge zones on the copy can be adjusted for any arbitrary size of the original and any arbitrary size of the receiving material, as required. Other advantages of the invention will become apparent from a perusal of the following detailed description of presently preferred embodiments taken in connection with the accompanying drawings.

PRESENTLY PREFERRED EMBODIMENTS

Figure 1:
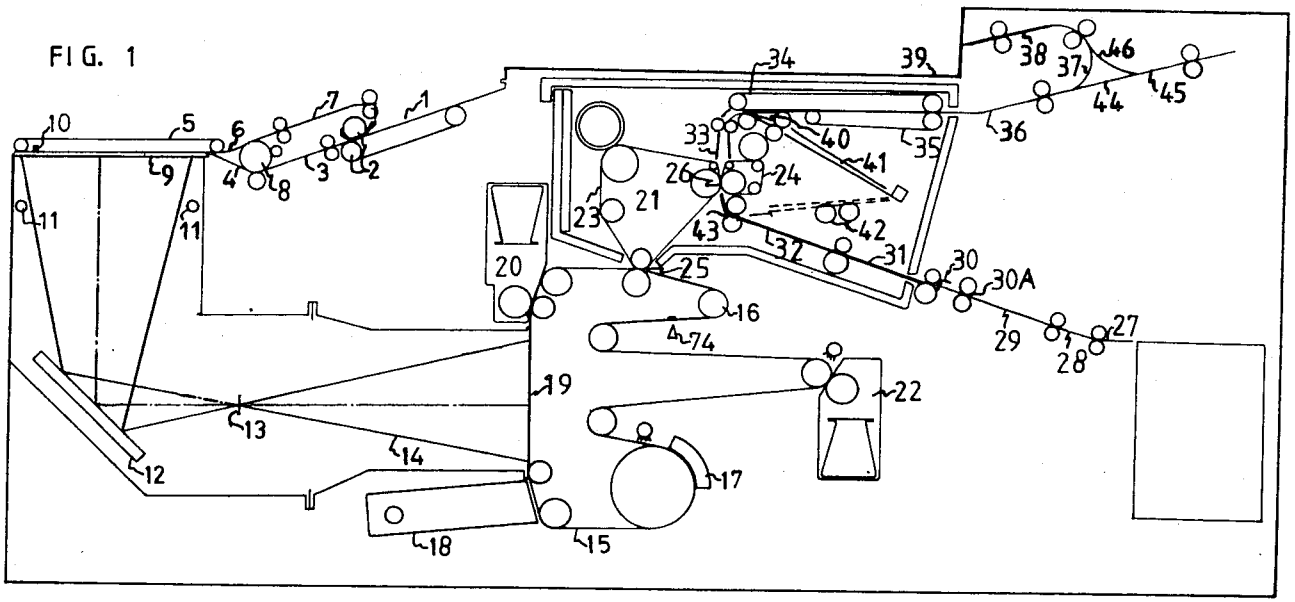
FIG. 1 represents a diagrammatic sectional view of a reproduction device incorporating the present invention.

Referring to FIG. 1, an electrophotographic copying machine equipped with a recirculating original feed and discharge device is shown. The copying machine consists of a holder 1 with a sheet separating mechanism 2, a feed path 3, 4, a conveyor belt 5, the direction of transport of which is reversible, a return feed path 6, 7 and a reversing path formed by path section 6, roller 8 and path section 4. An original fed via feed path 3, 4 from the bottom of a stack of originals in holder 1 is conveyed by conveyor belt 5 over the exposure window 9 to bar 10 resting on the exposure window 9.

After exposure, the original, if it has an image on only one side, is returned via the return feed path 6, 7 to the top of the stack in holder 1. If the original has an image on both sides it is conveyed through the reversing path 6, 8, and 4, after the first exposure by means of which it is returned to the exposure window 9 in the reversed position. After the second exposure the original is then returned to the holder 1 via the return feed path 6, 7.

The exposure device of the copying machine comprises flash lights 11, a flat mirror 12 and a zoom lens 13 which is displaceable along line 14 to vary the imaging ratio. A photoconductive element 15 runs over a number of rollers, which are not given any references in FIG. 1, and a drive roller 16. Disposed successively along the path of the photoconductive element 15 is charging device 17, discharge device 18 for fading out those zones of the photoconductive element 15 which are situated outside the imaging plane, developing device 20 for developing a charge image formed in the exposure plane 19, a transfer device 21 and a cleaning device 22. Transfer device 21 comprises a first endless belt 23 provided with a soft resilient outer covering of silicone rubber and a second similar endless belt 24. Belt 23 is heated by heating means (not shown in FIG. 1). The belt 23 presses against the photoconductive element 15 in a first pressure zone 25, where it takes the powder image over from the photoconductive element. The image, which has softened in the meantime, is transferred from belt 23 to a sheet of receiving material in a second pressure zone 26. This sheet of receiving material is fed via guides 27, 28 and 29, first to a position against a retaining member 30, where the sheet is aligned, and then into the nip of the conveyor rollers 43. Thereafter the sheet is fed to the pressure zone 26 for a selected time. A printed sheet is discharged via guide 33.

When copies printed on only one side are required, the copy is then fed between the cooperating conveyor belts 34 and 35 and adjoining guides 36, 37 and 38, to collecting table 39. When copies printed on both sides are required, deflector 40 is moved upwardly so that a sheet printed on one side supplied via guide 33 is fed to holder 41. Holder 41 is then brought into the position shown in broken lines and the sheet printed on one side is conveyed by the rollers 42 to the nip between rollers 43. From there the sheet is again conveyed to pressure zone 26. A copy printed on both sides is fed to collecting table 39 via the guides 33, 36, 44, 45, 46 and 38 or via guides 33, 36, 37 and 38. When copies printed on both sides are being made from originals printed on only one side, the copies are always transported via the guides 33, 36, 44, 45, 46 and 38. If the copies printed on both sides are made from double-sided originals, the copy transport is via guides 33, 36, 44, 45, 46 and 38 during the production of the odd copy sets (1st, 3rd, . . . copy set) and via guides 33, 36, 37 and 38 during the production of the even copy sets (2nd, 4th . . . copy set). This process is described in detail in European Patent Application No. 0073071.

Figure 2:
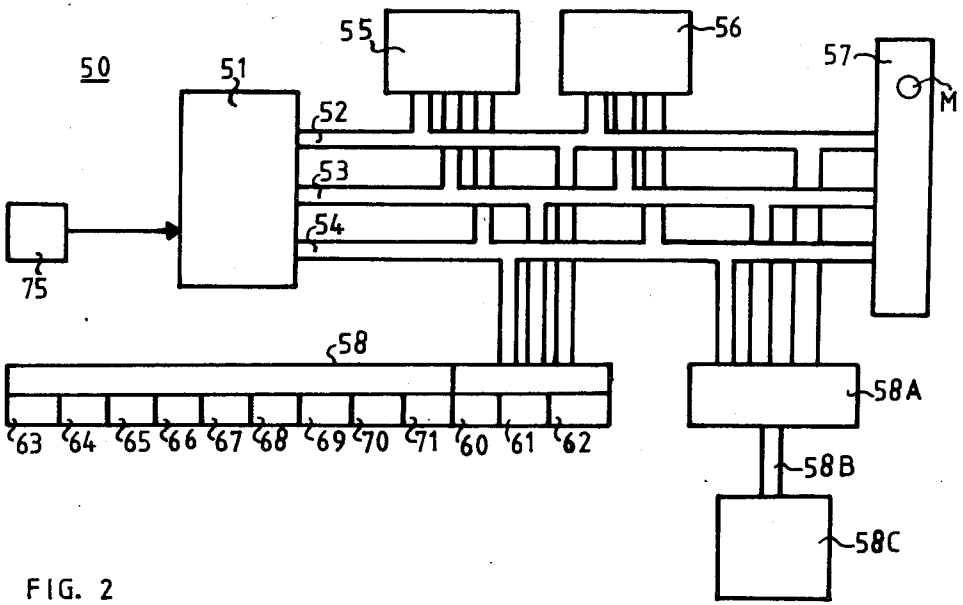
FIG. 2 represents a control device for controlling device.

A control device 50 is provided to control the copying machine. As shown in FIG. 2, control device 50 comprises a central processing unit 51 connected via data bus 52, address bus 53 and control bus 54, to a read-only memory (ROM) 55, a random access read/-write memory (RAM) 56, control panel 57 for inputting data and reproducing the input data concerning a required copying job, and connecting circuits 58 and 58A. Connecting circuit 58 comprises a number of input gates 60 . . . 62 and a number of output registers 63 . . . 71. The central processing unit 51 can select one of the input gates 60 . . . 62 or one of the output registers 63 . . . 71 via address bus 53. The central processing unit 51 can read the input signals of the selected input gate or load a selected output register via data bus 52. The loading or reading process controls the central processing unit 51 along control bus 54. The input of input gate 60 is connected to a detector 74 (see FIG. 1). The inputs of the other input gates are connected to detectors disposed elsewhere in the copying machine for monitoring the copying process and, inter alia, checking whether the originals and sheets of receiving material are conveyed in the correct way. The outputs of registers 63, 64, 65, 66, 67, 68, 69, 70 and 71 are connected to the control inputs of the original feed and discharge device, the ignition device for flash lights 11, charging device 17, discharge device 18, energizing device for retaining member 30 and conveyor rollers 30A, the drive means for rollers 43, deflector 40, the actuating means for holder 41 and conveyor rollers 42, and the actuating means for actuating the deflector in front of the entry to guides 37 and 44, respectively.

Connecting circuit 58A comprises a number of output registers whose inputs are connected to data bus 52 and whose outputs are connected via bus 58B to the adjustment device for zoom lens 13. Connecting circuit 58A is also connected to address bus 53 and control bus 54. During the loading of the output registers, connecting circuit 58A is first selected via address bus 53 and is then so controlled via control bus 54 that the data offered via data bus 52 are loaded into the output registers. Via bus 58C the data loaded in connecting circuit 58A are offered to the adjusting device for the zoom lens 13, whereupon the adjusting device adjusts the zoom lens according to the offered data.

A pulse generator 75 is connected to the program interrupt input of the central processing unit 51 and delivers pulses at a frequency proportional to the speed of the photoconductive element 15. To control the copying process, the central processing unit 51 performs a program which is stored in read-only memory 55. Depending upon the copying order input via the control panel and the positions in which the various copies being made are situated inside the copying machine, the central processing unit 51 controls the on and off switching of the members and devices required to make the copy.

For registering the positions of the copies being made, the program makes use of a pulse counter, with which for each copy being made, registration is carried out in response to the number of pulses generated by the pulse generator 75 from the time at which the copying process was started for the copy in question. The execution times of each switching-on and switching-off command for the various functions of the copying machine are stored in the memory in an action table and are expressed in that action table as the number of pulses requiring to be counted from the start of the copying process for the copy in question. After each newly generated pulse of pulse generator 75 the pulse counter is updated and the updated counter state is compared with the content of the associated action table and, if a counter state has been reached at which a command must be executed, the program subroutine required for that purpose is started.

In executing a copying order in which no instruction is input via control panel 57 to change the width of the image-free edge zones on the copies, the various functions of the copying machine are so controlled in accordance with a standard action table that the edge of an original abutting bar 10 is reproduced on the trailing edge of the sheet of receiving material. The originals and the receiving material are fed through the copying machine in the transverse direction.

By pressing button M on control panel 57 the central processing unit 51 is instructed that a copying order is required to be executed in which the width of the image-free edge zones must be changed at the left and right-hand sides of the copy. After buttom M has been pressed, the operator inputs via control panel 57 the data concerning the width of the image-free left-hand and right-hand edge zone of the original and these data are stored at places intended for that purpose in the read/ write memory 56. If the originals are printed on both sides, something that the operator has indicated by pressing a button intended for that purpose on the control panel 57, then after the inputting of the data concerning the front of the original, the data concerning the width of the image-free edge zones of the back of the original are also input. In the event of there being no data input concerning the back of the original, the central processing unit 51 assumes that the image areas of the front and back of the original coincide, and hence that the left-hand edge zone of the back is equal to the right-hand edge zone of the front and that the right-hand edge zone of the back is equal to the left-hand edge zone of the front. After inputting the data concerning the original, the data relating to the required minimum width of the corresponding image-free edge zones on the receiving material are input via control panel 57 and these data are also stored in places intended for that purpose in the read/write memory 56.

The latter data, however, are preferably already programmed in a non-volatile part of the read/write memory 56 to eliminate the need for the operator to re-input the data. Such data can be changed by a service engineer or by the operator himself. The data concerning the image-free edge zone on the copy includes, for example, the required width of the image-free edge zone on the hand side of the copy and the minimum width of the image-free edge zone on the right-hand side of the copy (looking at the copy in the reading direction).

By reference to the data input relating to the dimensions of the image-free edge zones of the original, the input or previously stored data concerning the minimum dimensions required for the corresponding edge zones on the copy, and the received or stored data concerning the dimensions of the original and the receiving material, the central processing unit 51 carries out a calculation routine by means of which tne imaging ratio and the required adjustment and/or activating times of one or more process functions are calculated. The associated process functions are then adjusted or activated in accordance with the determined values. The process functions which are adjusted to effect a change in the dimensions of the image-free edge zones on a copy are: bar 10 (which can be moved to the left or right over the exposure window 9); zoom lens 13 (which can be moved in a direction perpendicular to the optical axis); the drive for the photoconductive element 15 (increasing or reducing the speed of element 15). The process functions in which the activation time is charged to effect a change in the dimensions of the image-free edge zones on the copy are: the activation time of flash lights 11, and the activation time of conveyor rollers 43.

By changing the imaging ratio (in this case reducing the image) the total of the dimensions of the image-free edge zones is increased. By varying one or more of the above process functions the total of the dimensions remains constant, but the ratio between the dimensions varies.

Figure 3A:
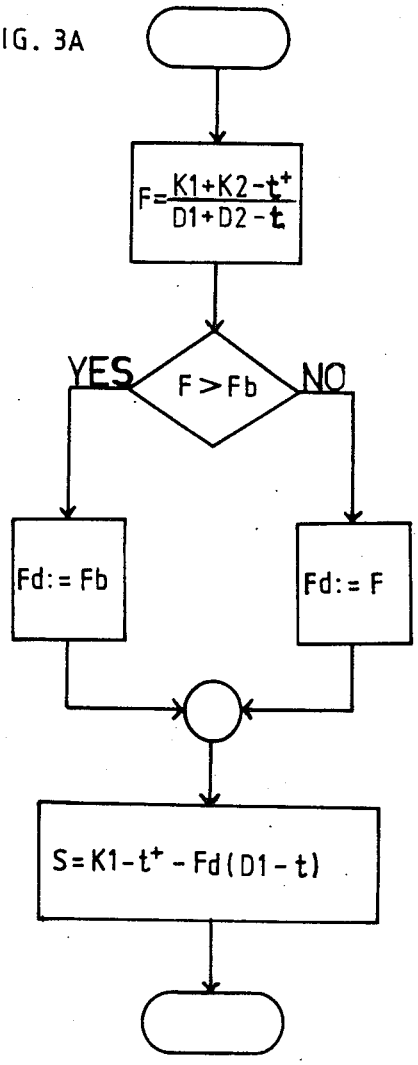
FIGS. 3A–3D each represent flow diagrams of a calculation routine carried out by the central processing unit.

Referring to FIG. 3A, a flow diagram of the calculation routine introduced by the central processing unit 51 in order to determine the imaging ratio and the adjustment or activation time of one of the process functions for the copying order single-sided originals/ single-sided copies is shown. For example, the activation time of conveyor rollers 43 is calculated by first calculating the imaging ratio in accordance with the equation (A) below using the data relating to the width of the image-free edge zones of the original, the required width of the corresponding edge zones on the copies, the length of the original and of the receiving material (both as considered in the direction of conveyance):

$$F = \frac{K1 + K2 - t+}{D1 + D2 - t} \quad \text{(A)}$$

where

F is the imaging ratio;

Kl is the required width of the image-free edge zone on the left-hand side of the copy;

K2 is the required minimum width of the image-free edge zone on the right-hand side of the copy;

$t^+$is the length of the receiving material;

Dl is the width of the image-free edge zone on the left-hand side of the original;

D2 is the width of the image-free edge zone on the right-hand side of the original; and t is the length of the original.

The calculated imaging ratio F is compared with imaging ratio (Fb) selected by the operator and the lower of the two values is selected as the final imaging ratio Fd. The change S of the activation time of the conveyor rollers 43 is then determined from equation (B):

$$S = K1 - t^+ - \text{Fd}\ (D1 - t) \quad \text{(B)}$$

Before copying starts, the control device positions zoom lens 13 into the position associated with the final imaging ratio Fd and adjusts the standard action table intended for the copying order single-sided originals/ single-sided copies in accordance with calculated change S.

If S is positive, the activation time for the conveyor rollers 43 is brought forward with respect to the activation time stored in the standard action table, by a number of pulses from pulse generator 75 equivalent to the value calculated for S. If S is negative the activation time is delayed.

Figure 3B:
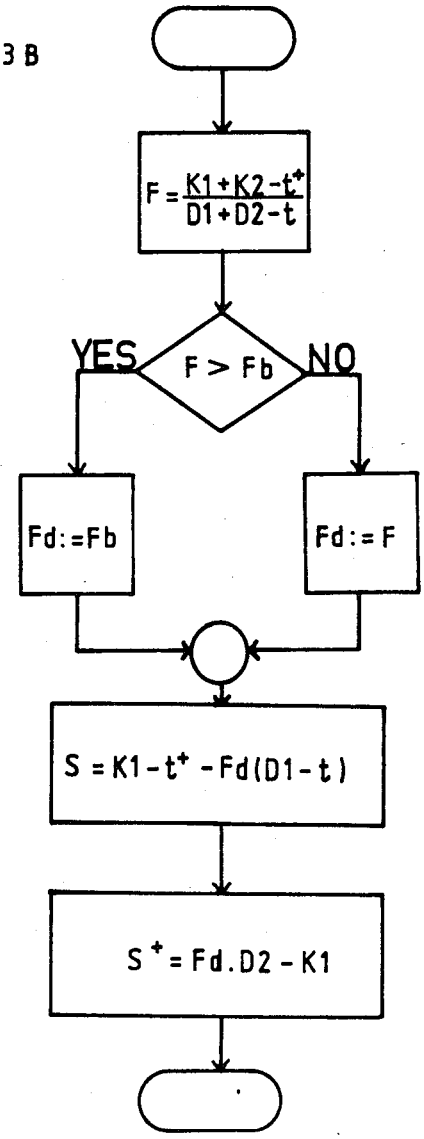

Referring to FIG. 3B a flow diagram for the calculation routine carried out for the copying order single-sided originals/ double-sided copies is shown. As with respect to the method described in connection with FIG. 3A, the imaging ratio Fd is first determined. S is then determined in accordance with equation (B) for the front of the copy. For the back of the copy, the image-free edge zone on the right-hand side must be equal to the image-free edge zone on the left-hand side of the front of the copy. For the back of the copy the change $S^+$ of the activation time of the conveyor rollers 43 is determined from equation (C):

$$S^+ = \text{Fd.D2} - K1\ \text{TM} \quad \text{(C)}$$

As described above, if S+ is positive, the activation time for conveyor rollers 43 is brought forward, and if S+ is negative, the activation time is delayed.

Figure 3C:
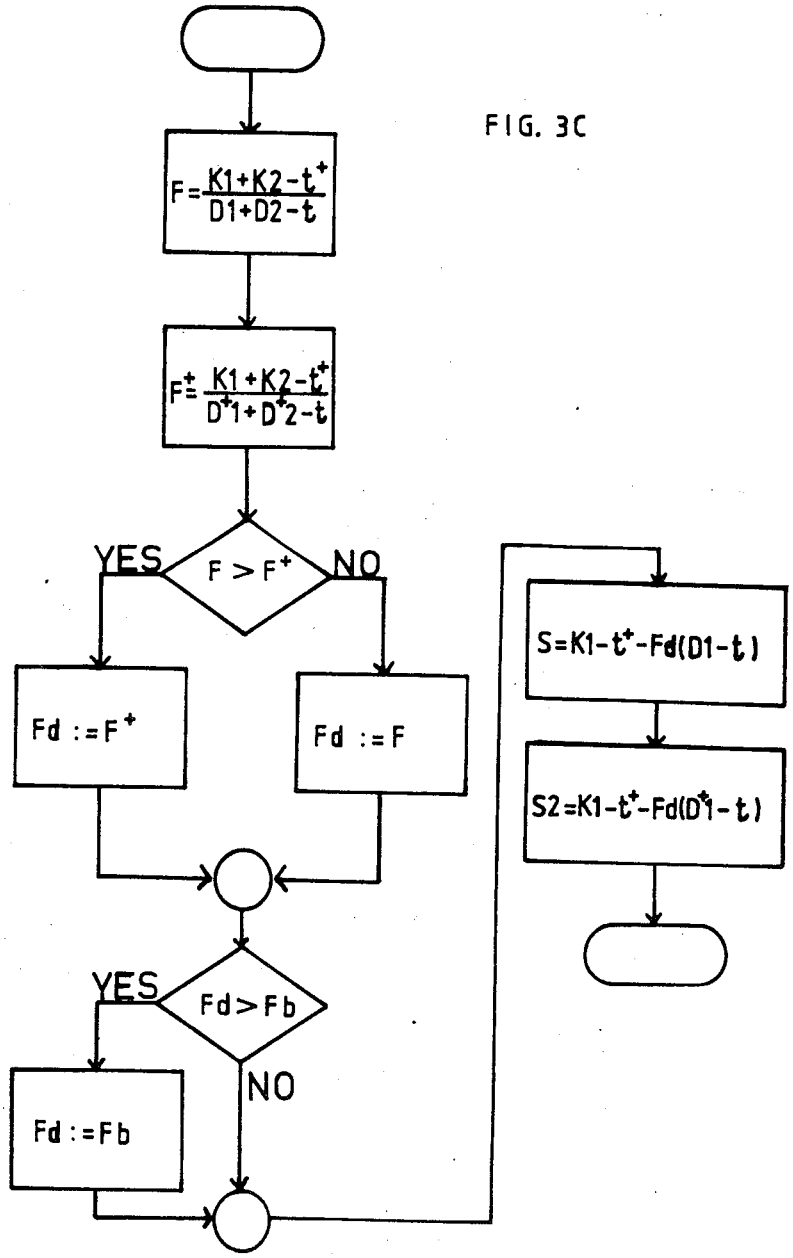

FIG. 3C represents the calculation routine for the copying order double-sided originals/single-sided copies. This imaging ratio is calculated from equations (A) and (G), below.

$$F = \frac{K1 + K2 - t+}{D1 + D2 - t} \quad (A)$$

$$F = \frac{K1 + K2 - t+}{D^{+}1 + D^{+}2 - t} \quad (G)$$

where,

D+1 is the width of the image-free edge zone on the left-hand side of the back of the original; and D+2 is the width of the image-free edge zone on the right-hand side of the back of the original.

The calculated results of (A) and (G) are compared with one another and the lower value of F is selected.

The final imaging ratio Fd is then determined in the manner as described above in connection with the copying order single-sided originals/single-sided copies, by comparing the smallest calculated value of F with the value (Fb) that the operator has indicated.

For copies originating from the front of an original the change S of the activation time of the conveyor rollers 43 is determined by equation (B):

$$S = K1 - t^{30} - Fd(D1 - t) \text{ tm (B)}$$

For copies originating from the back of an original the change S2 of the activation time for the conveyor rollers 43 is determined by equation (H):

$$S2 = K1 - t^{+} - Fd\,(D^{30}\,1 - t) \text{ tm (H).}$$

Given a positive result for S or S2, the activation time is brought forward whereas for a negative result it is delayed.

Figure 3D:
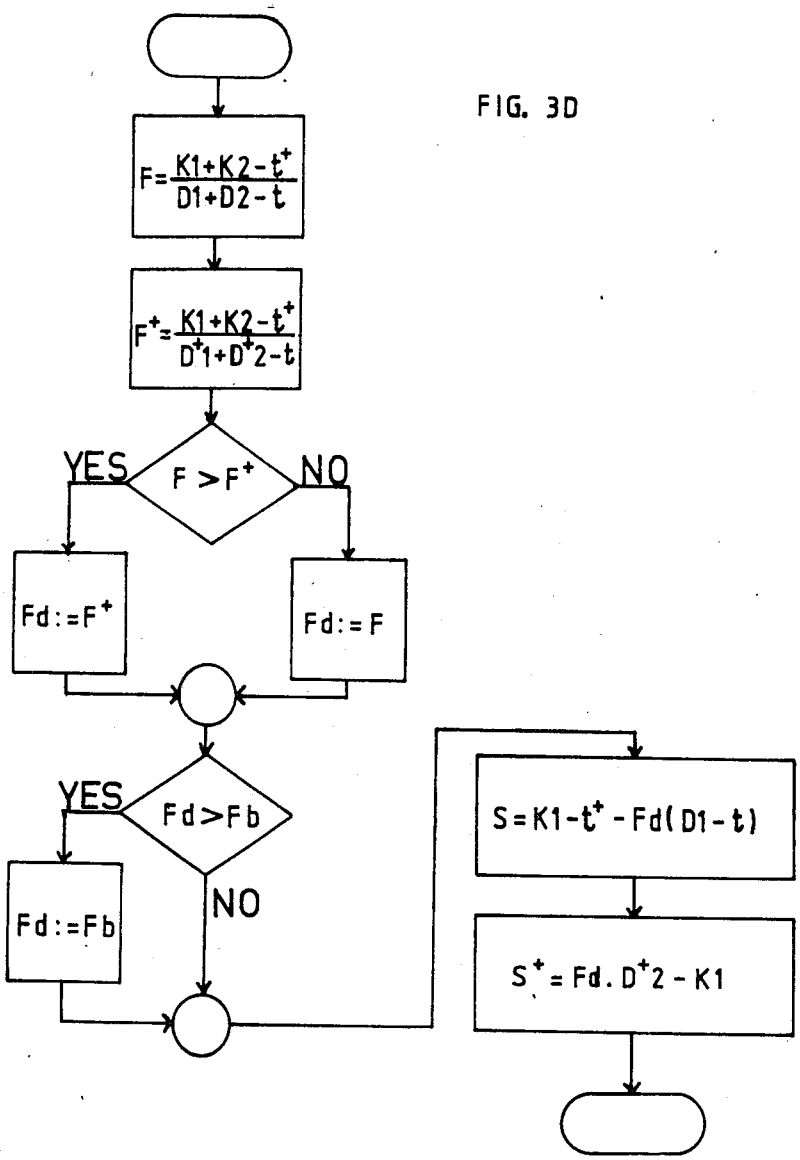

FIG. 3D represents the flow diagram of the calculation routine for copying double-sided originals/ double-sided copies. Fd is determined as described above for copying double-sided originals/single-sided copies.

For the front of the copy, the change S in activation time of conveyor rollers 43 is determined by means of equation (B):

$$S = K1 - t^{30} - \text{Fd}\,(D1 - t) \text{ tm (B)}$$

For the back of the copy the change S+ of the activation time is determined by means of equation (I):

$$S^{+} = Fd.D^{+}2 - Kl \quad (I)$$

Once again, the activation time for the conveyor rollers 43 is advanced in the case of a positive result for S or S+ and delayed for a negative result for S or S+.

It is apparent from the above equations that the length of the original and of the receiving material as viewed in their direction of conveyance must be inputted to unit 51 for the purpose of calculating the values of F, S and S2. If the copying machine is designed to process only one size of original and receiving material, these data will be stored in one of the memories 55 or 56. If the copying machine is intended for processing different original and receiving material sizes, then it may be equipped, in known manner, such as in holder 1 and the supply magazine for the stack of receiving material, with detectors which supply to central processing unit 51 signals representative of the original size and the receiving material size. The copying machine can also then be so constructed that the operator can input via the control panel 57 the data associated with the size of the original and of the receiving material.

The reproduction device according to the invention can of course also be so constructed that if an order is received to change the dimensions of the image-free edge zones of a copy the control device 50 always selects as the final imaging ratio Fd the imaging ratio F calculated by central processing unit 51. In all cases in which the calculated imaging ratio F is within the range adjustable with zoom lens 13, the resulting copies will have an image-free edge zone width equal to the values input by the operator. If the calculated imaging ratio F is outside the range adjustable by zoom lens 13, then the closest adjustable value is selected for Fd. If the calculated imaging ratio F is larger than 1, the image on the copy is enlarged as far as the reproduction device has the facility for this. It is also possible to program the control device so that image enlargement is never carried out. If the calculated imaging ratio F is larger than 1, then the value 1 will be selected for Fd.

Control device 50 can be constructed so that the operator can input the values of Dl, D2, D+1 and D+2 separately via the control panel for each original to be copied, or so that the operator can input only one value for Dl, D2, D+1 and D+2, respectively, for each copying order required.

Since the originals belonging to the same document have in practice always about the same dimensions for the image-free edge zones, the latter embodiment will virtually never give rise to any problems and has the advantage that the inputting of the data concerning the required copying order can be carried out quickly. If, nevertheless, some originals in a document have image-free edge zones whose dimensions differ from those of the other originals, the operator can first make copies of those differing originals, the dimensions of the image-free edge zones of the copies corresponding to those of the other originals. These copies can then be included by the operator in the set of originals for copying corresponding to those of the other originals. In many copying departments the originals of different documents practically always have the same dimensions for the image-free edge zones. To enable copying orders to be carried out quickly with such "standard originals", it is possible to construct control device 50 so that a fixed value for Dl, D2, D+1 and D+2 of the original, respectively, can be programmed in memory 56 and can be called up via the control panel whenever "standard originals" have to be copied.

While presently preferred embodiments have been described and shown in detail, the invention may be otherwise embodied within the scope of the appended claims.

We claim:

1. In a reproduction device comprising means for transferring an image from a temporary image support to a sheet of receiving material and having process functions, including imaging means the imaging ratio of which can be varied, for applying an image of an original to said temporary image suppport and means for feeding a sheet of receiving material to said transfer means for feeding a sheet of receiving material to said transfer means and process control means for controlling said process functions, the improvement in combination therewith comprising data rentention means connected to said process control means for inputting data relating to the width of each of two oppositely situated image-free edge zones of said original to be reproduced and the required minimum width of corresponding edge zones on said sheet of receiving material, and calculating means associated with said process control means to calculate the imaging ratio and an adjustment or an activation time of at least one of the process functions in response to data from said retention means, whereby the required minimum width of the edge zones on the receiving material can be obtained and generate control signals to control the relevant process functions in accordance with said calculation.

2. In a device according to claim 1, the improvement wherein said retention means for the data concerning the minimum width to be realized for the image-free edge zones on the receiving material is a read/write memory and said data can be programmed therein.

3. In a device according to claims 1 or 2 the improvement comprising means for supplying the process control means with data as to the size of the original and the size of the receiving material.

4. The device according to claims 1 or 2 wherein said data concerning the width of image-free edge zones of a "standad original" are programmed in a read/write memory.

* * * * *

UNITED STATES PATENT AND TRADEMARK OFFICE

CERTIFICATE OF CORRECTION

PATENT NO. : 4,674,864

DATED : June 23, 1987

INVENTOR(S) : ADDY G. F. STAKENBORG, ANDREAS T. HEYNEN and GERARDUS J. M. HENDERICKS It is certified that error appears in the above-identified patent and that said Letters Patent is hereby corrected as shown below:

Column 1, line 5, before "free" insert -- image- --;

Column 2, line 30, after "the" delete "imagage-free" and substitute therefor -- image-free --;

Column 2, line 41, after "controlling" insert -- the --;

Column 5, line 36, before "hand" insert -- left- --;

Column 6, line 64, after "change" delete "S+" and substitute therefor -- $S^+$ --;

Column 6, line 66, delete "$S^+$=Fd.D2--Kl TM(C)" and substitute therefor -- $S^+$=Fd.D2-Kl (C) --;

Column 7, line 1, after "if" delete "S+" and substitute therefor -- $S^+$ --;

Column 7, line 2, after "if" delete "S+" and substitute therefor -- $S^+$ --;

Column 7, line 11, delete "D+1" and substitute therefor -- $D^+1$ --;

Column 7, line 13, delete "D+2" and substitute therefor -- $D^+2$ --;

Column 7, line 30, delete "S=Kl-$t^{30}$-Fd(Dl-t)tm(B)" and substitute therefor -- S=Kl-$t^+$-Fd(Dl-t) (B) --;

Column 7, line 35, delete "S2=Kl-$t^+$-Fd($D^{30}$l-t)tm(H)." and substitute therefor -- S2=Kl-$t^+$-Fd($D^+$l-t) (H) --;

Column 7, line 48, delete "S=Kl-$t^{30}$-Fd(Dl-t)tm(B)" and substitute therefor -- S=Kl-$t^+$-Fd(Dl-t) (B) --;

Column 7, line 56, after "or" delete "S+" and substitute therefor -- $S^+$ --;

Column 7, line 46, after "or" delete "S+" and substitute therefor -- $S^+$ --;

Column 8, line 24, after "D2," delete "D+1" and substitute therefor -- $D^+1$ --;

Column 8, line 24, after "and" delete "D+2" and substitute therefor -- $D^+2$ --;

UNITED STATES PATENT AND TRADEMARK OFFICE

CERTIFICATE OF CORRECTION

PATENT NO. : 4,674,864

DATED : June 23, 1987

INVENTOR(S) : ADDY G. F. STAKENBORG, ANDREAS T. HEYNEN and GERARDUS J. M. HENDERICKS It is certified that error appears in the above-identified patent and that said Letters Patent is hereby corrected as shown below:

Column 8, line 27, after "and" delete "D+2" and substitute therefor -- $D^{+}2$ --;

Column 8, line 48, after "and" delete "D+2" and substitute therefor -- $D^{+}2$ --;

Column 8, line 67, after "data" delete "rentention" and substitute therefor -- retention --; and Column 10, line 12, after "a" delete ""standad" and substitute therefor -- "standard --.

Signed and Sealed this

Sixteenth Day of August, 1988

*Attest:*

DONALD J. QUIGG

*Attesting Officer*

*Commissioner of Patents and Trademarks*